US010857571B2

(12) United States Patent
Bonilla

(10) Patent No.: US 10,857,571 B2
(45) Date of Patent: Dec. 8, 2020

(54) CLEANING ASSEMBLY

(71) Applicant: Elizabeth Bonilla, Los Angeles, CA (US)

(72) Inventor: Elizabeth Bonilla, Los Angeles, CA (US)

( * ) Notice: Subject to any disclaimer, the term of this patent is extended or adjusted under 35 U.S.C. 154(b) by 0 days.

(21) Appl. No.: 16/176,023

(22) Filed: Oct. 31, 2018

(65) Prior Publication Data

US 2020/0130021 A1 Apr. 30, 2020

(51) Int. Cl.
*B08B 1/00* (2006.01)

(52) U.S. Cl.
CPC ..... *B08B 1/006* (2013.01)

(58) Field of Classification Search
CPC ... B08B 3/08; B08B 1/00; A47L 13/12; A47L 13/19; A47L 13/18
See application file for complete search history.

(56) References Cited

U.S. PATENT DOCUMENTS 1,994,425 A * 3/1935 Weller ..... A47L 13/19 15/104.94
5,473,789 A * 12/1995 Oster ..... A47L 13/19 15/104.94
5,569,521 A * 10/1996 Francoeur, Sr. ..... A47L 13/18 428/171
5,894,623 A * 4/1999 Thill ..... A47L 25/005 134/6
6,481,443 B1 * 11/2002 Moore-Johnson ... A45D 29/007 132/73
D562,515 S 2/2008 Treacy
8,707,505 B2 4/2014 Maranghi
8,881,331 B2 11/2014 Gibis
2005/0251941 A1 11/2005 Berhoff
2008/0107473 A1 * 5/2008 Deleonardis ..... A46B 9/005 401/196
2010/0064463 A1 * 3/2010 Beatty ..... B65H 45/00 15/227
2010/0144257 A1 6/2010 Beaumont
2013/0227807 A1 9/2013 Bruno
2016/0092835 A1 3/2016 Collette
2016/0316986 A1 * 11/2016 Oster ..... B08B 1/006

FOREIGN PATENT DOCUMENTS

WO WO0103566 1/2001

* cited by examiner

*Primary Examiner* — Dung Van Nguyen
(74) *Attorney, Agent, or Firm* — Colin P. Abrahams

(57) ABSTRACT

A cleaning assembly for cleaning a surface includes a plurality of first panels. The first panels are stacked on top of each other. Each of the first panels is comprised of a deformable material thereby facilitating each of the first panels clean a surface. A coupler is provided that selectively engages a finger. The coupler is coupled to each of the first panels thereby facilitating the plurality of first panels to be manipulated to clean the surface.

9 Claims, 4 Drawing Sheets

CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for cleaning a surface.

BRIEF SUMMARY OF THE INVENTION

An embodiment of the disclosure meets the needs presented above by generally comprising a plurality of first panels. The first panels are stacked on top of each other. Each of the first panels is comprised of a deformable material thereby facilitating each of the first panels clean a surface. A coupler is provided that selectively engages a finger. The coupler is coupled to each of the first panels thereby facilitating the plurality of first panels to be manipulated to clean the surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
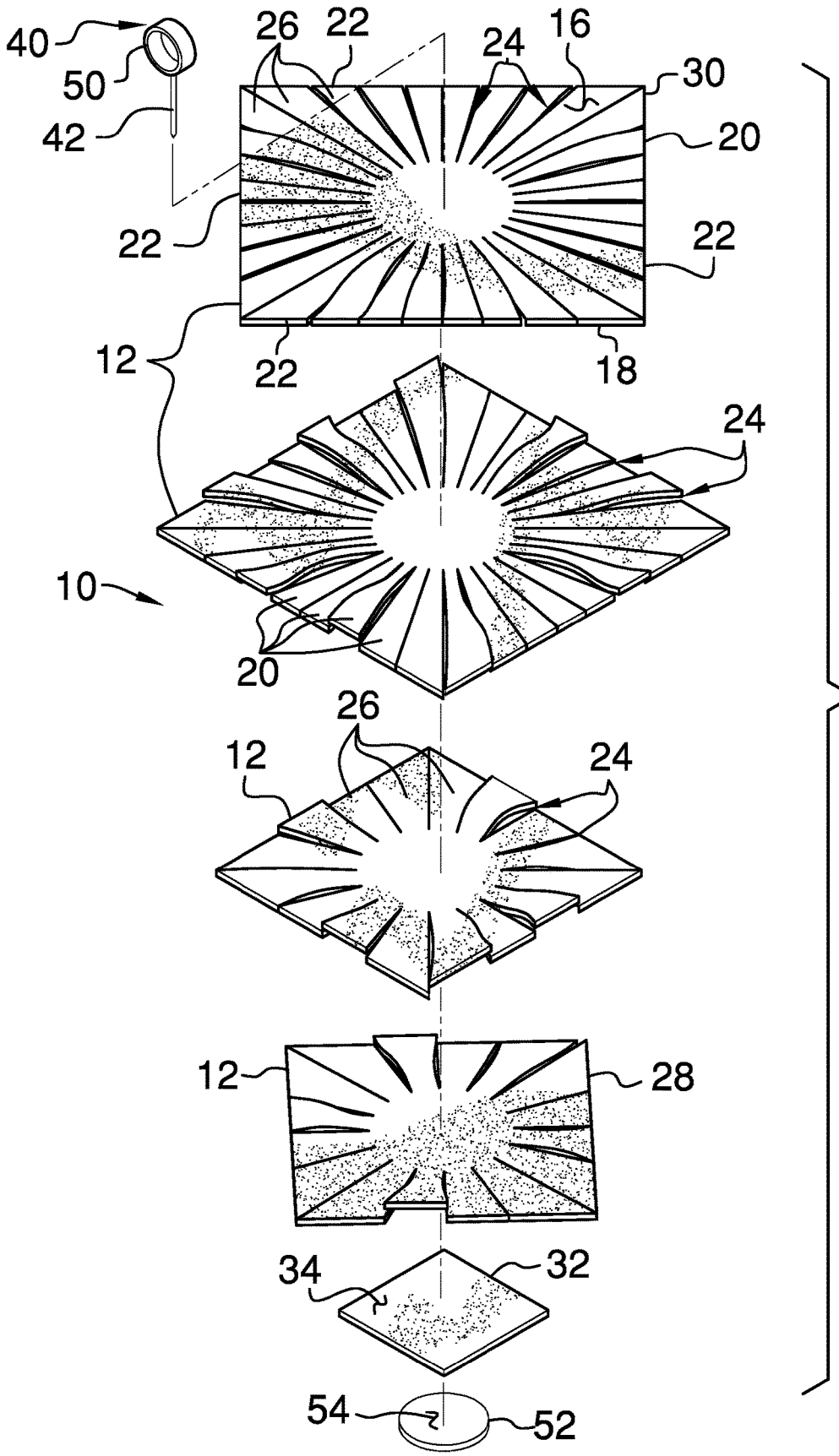
FIG. 1 is an exploded perspective view of a cleaning assembly according to an embodiment of the disclosure.
Figure 2:
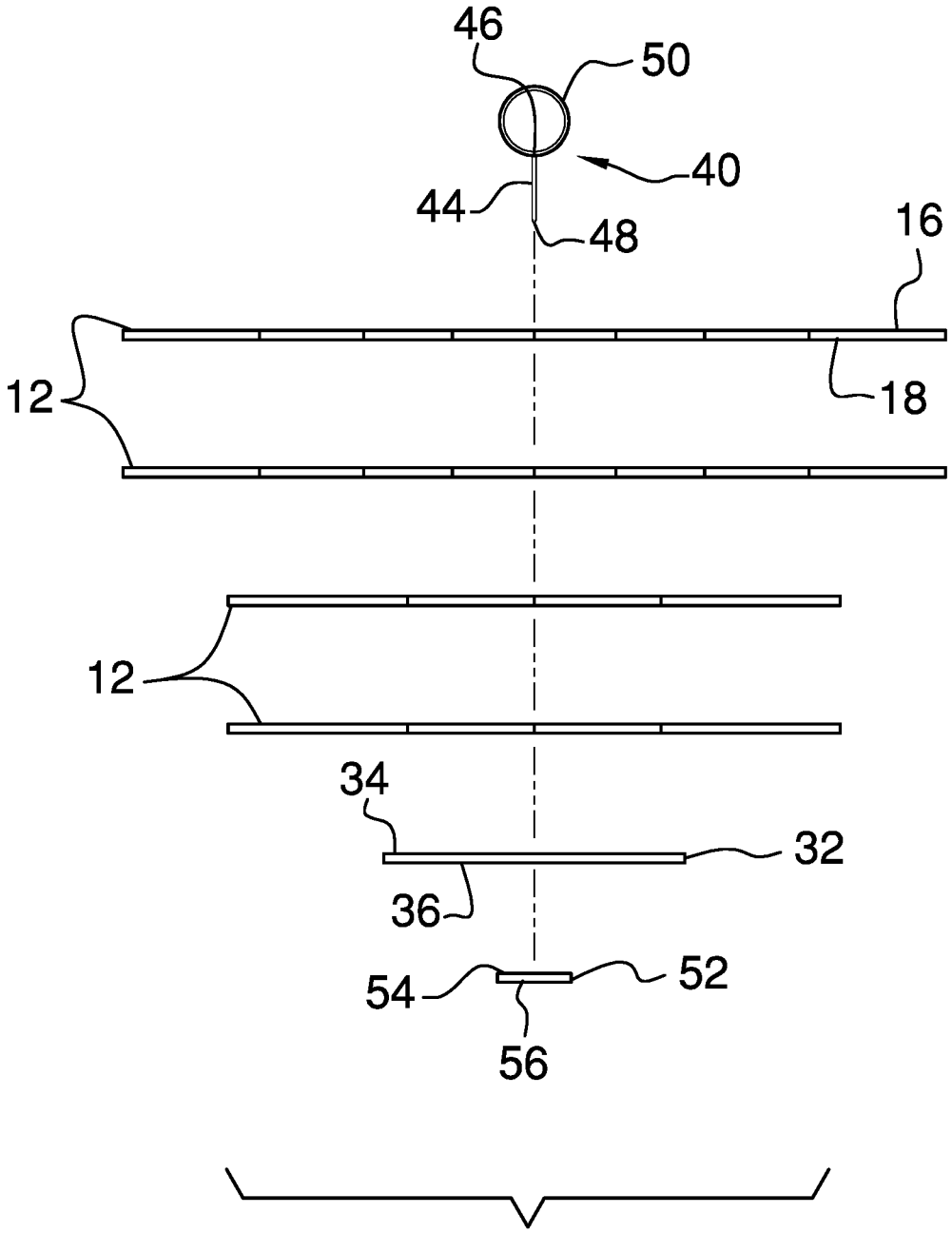
FIG. 2 is an exploded front view of an embodiment of the disclosure.
Figure 3:
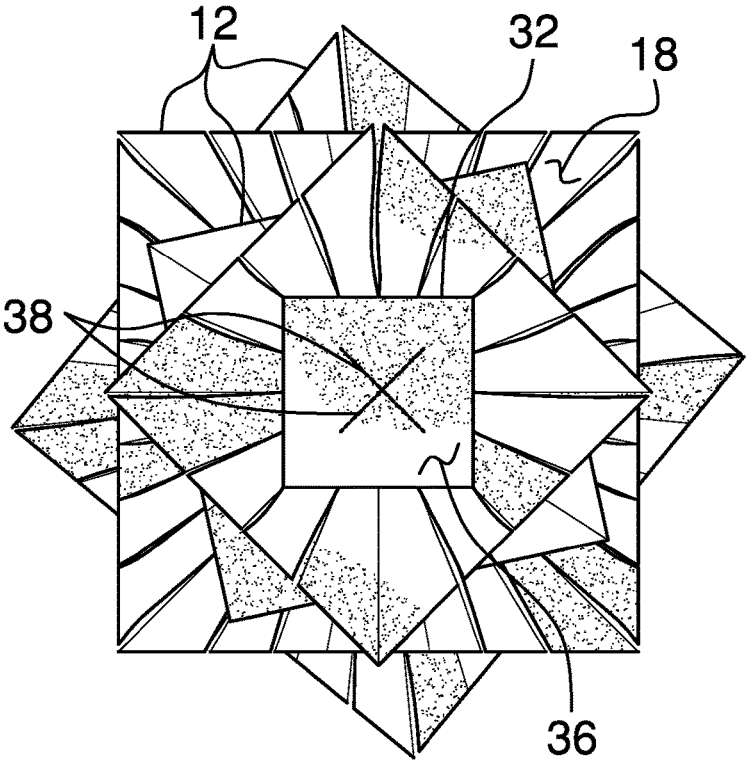
FIG. 3 is a bottom view of an embodiment of the disclosure.
Figure 4:
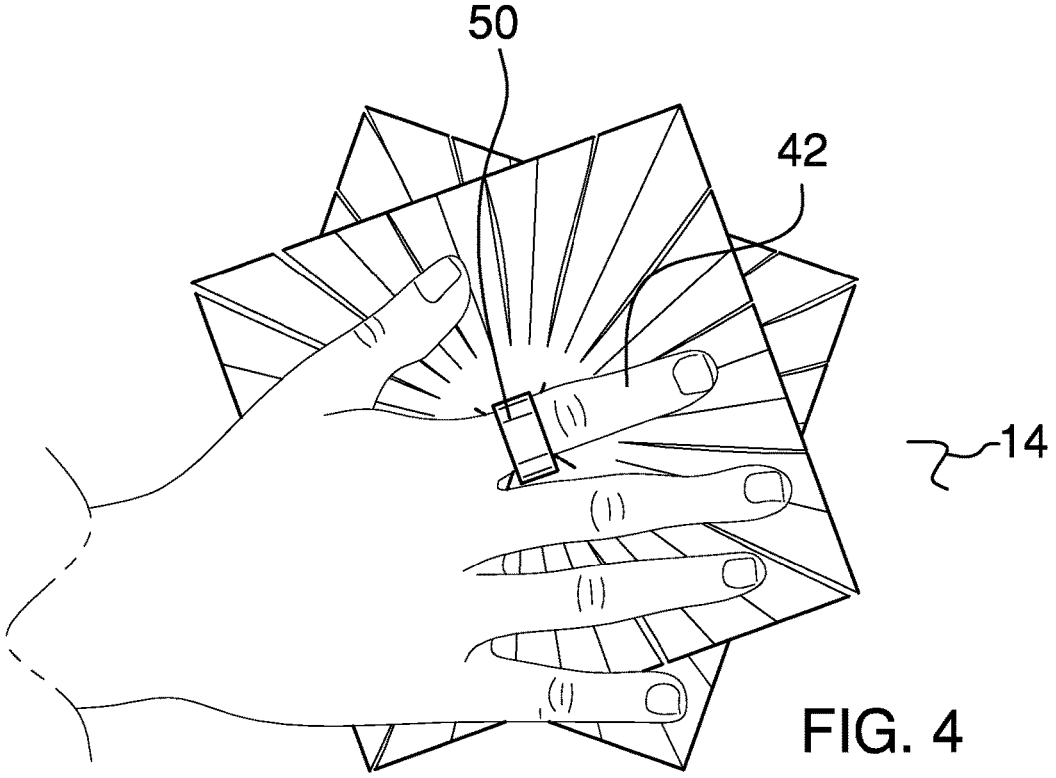
FIG. 4 is a perspective in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the cleaning assembly 10 generally comprises a plurality of first panels 12 and each of the first panels 12 is stacked on top of each other. Each of the first panels 12 is comprised of a deformable material such as micro fiber or the like. Thus, each of the first panels 12 may clean a surface 14 without abrading the surface 14. The surface 14 may be a table top, a window and any other surface 14 that needs cleaning.

Each of the first panels 12 has a first surface 16, a second surface 18 and a perimeter edge 20 extending therebetween. The perimeter edge 20 has a plurality of intersecting sides 22 such that each of the first panels 12 has a rectangular shape. Each of the first panels 12 has a plurality of cuts 24 and the plurality of cuts 24 corresponding to each of the first panels 12 extends through the first 14 and second 18 surfaces of the corresponding first panel 12. The plurality of cuts 24 on each of the first panels 12 extends from the perimeter edge 20 of the corresponding first panel 12 toward a center of the corresponding first panel 12.

The plurality of cuts 24 on each of the first panels 12 is spaced apart from each other and is distributed around the corresponding panel. Moreover, the cuts 24 on each of the first panels 12 define a plurality of tentacles 26 on each of the first panels 12. Each of the first panels 12 is oriented to be offset with respect to each other such that four corners corresponding to each of the first panels 12 is offset with respect to adjacent first panels 12. The stacked first panels 12 include a bottom first panel 28 and a top first panel 30. Additionally, the total number of tentacles 26 may be approximately 96.0 tentacles.

A second panel 32 is positioned on the bottom first panel 12 and the second panel 32 has a primary surface 34 and a secondary surface 36. The second panel 32 has a plurality of perforations 38 and each of the perforations 38 extends through the primary 34 and secondary 36 surfaces. The perforations 38 are oriented to form an X that is centrally positioned on the second panel 32. The second panel 32 is comprised of a deformable material such as micro fiber or the like. The plurality of first panels 12 may have a decreasing perimeter between the top first panel 30 and the bottom first panel 28. Additionally, the second panel 32 may have a perimeter that is less than the perimeter of the bottom first panel 28.

A coupler 40 is provided and the coupler 40 selectively engages a finger 42. The coupler 40 is coupled to each of the first panels 12 and the second panel 32. Thus, the plurality of first panels 12 and the second panel 32 may be selectively manipulated to clean the surface. The coupler 40 comprises a pin 44 that has a first end 46 and a second end 48. The pin 44 extends through each of the first panels 12 and the perforations 38 on the second panel 32.

Figure 5:
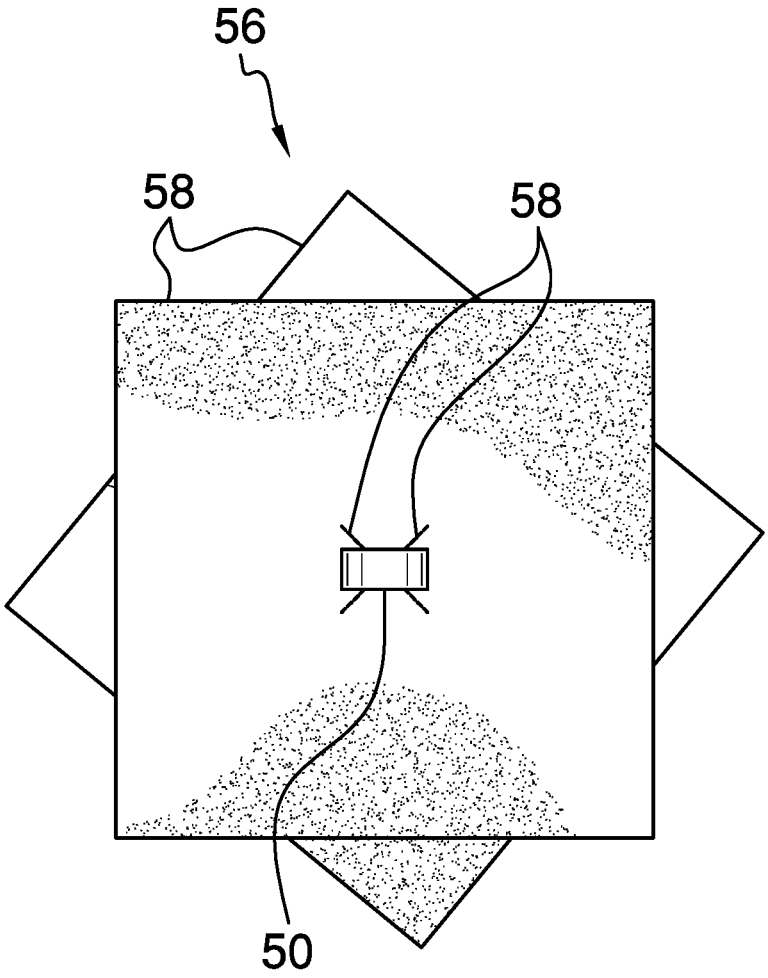
FIG. 5 is a top view of an alternative embodiment of the disclosure.

A ring 50 is coupled to the first end 46 and the ring 50 lies on the first surface 16 corresponding to the top first panel 12. The finger 42 is selectively extended through the ring 50. A disk 52 is provided that has a first surface 54 and the first surface 54 of the disk 52 is coupled to the second end 48 of the pin 44. Additionally, the first surface 54 of the disk 52 abuts the secondary surface 36 of the second panel 32. In this way the disk 52 inhibits the pin 44 from being removed from the second panel 32. In an alternative embodiment 56 as shown in FIG. 5, a pair of panels 58 may be provided. The cuts 24 may be absent from each of the panels 58 in the alternative embodiment 56. Additionally, one of the panels 58 may have the perforations 38 in the alternative embodiment 56.

In use, the finger 42 is extended through the ring 50 thereby facilitating the first panels 12 and the second panel 32 to be manipulated. The first panels 12 and second panel 32 are wiped across the surface 14 thereby facilitating the surface 14 to be dusted and cleaned. Each of the first panels 12 and the second panel 32 may be laundered at any time. Moreover, a detergent may be applied to the first panels 12 and the second panel 32 to aid in cleaning the surface 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cleaning assembly being configured to be worn on a finger thereby facilitating said assembly to clean surfaces, said assembly comprising:

a plurality of first panels, said first panels being stacked on top of each other, each of said first panels being comprised of a deformable material wherein each of said first panels is configured to clean a surface;

a coupler being configured to engage a finger, said coupler being coupled to each of said first panels wherein said plurality of first panels is configured to be manipulated to clean the surface; and wherein each of said first panels has a first surface, a second surface and a perimeter edge extending therebetween, said perimeter edge having a plurality of intersecting sides such that each of said first panels has a rectangular shape, each of said first panels having a plurality of cuts, said plurality of cuts corresponding to each of said first panels extending through said first and second surfaces of said corresponding first panel, said plurality of cuts on each of said first panels extending from said perimeter edge of said corresponding first panel toward a center of said corresponding first panel.

2. The assembly according to claim 1, wherein said plurality of cuts on each of said first panels is spaced apart from each other and being distributed around said corresponding panel to define a plurality of tentacles on each of said first panels.

3. The assembly according to claim 2, wherein each of said first panels is oriented to be offset with respect to each other such that four corners corresponding to each of said first panels is offset with respect to adjacent first panels, said stacked panels including a bottom first panel and a top first panel.

4. The assembly according to claim 1, further comprising a second panel being positioned on a bottom one of said first panels, said second panel having a primary surface and a secondary surface, said second panel having a plurality of perforations, each of said perforations extending through said primary and secondary surfaces, said perforations being oriented to form an X being centrally positioned on said second panel.

5. The assembly according to claim 4, wherein said coupler comprises a pin having a first end and a second end, said pin extending through each of said first panels and said perforations on said second panel.

6. The assembly according to claim 5, further comprising a ring being coupled to said first end having said ring lying on a first surface corresponding to a top one of said first panels wherein said ring is configured to have the finger extended therethrough.

7. The assembly according to claim 6, further comprising a disk having a first surface, said first surface of said disk being coupled to said second end of said pin having said first surface of said disk abutting said secondary surface of said second panel such that said disk inhibits said pin from being removed from said second panel.

8. A cleaning assembly being configured to be worn on a finger thereby facilitating said assembly to clean surfaces, said assembly comprising:

a plurality of first panels, said first panels being stacked on top of each other, each of said first panels being comprised of a deformable material wherein each of said first panels is configured to clean a surface, each of said first panels having a first surface, a second surface and a perimeter edge extending therebetween, said perimeter edge having a plurality of intersecting side such that each of said first panels has a rectangular shape, each of said first panels having a plurality of cuts, said plurality of cuts corresponding to each of said first panels extending through said first and second surfaces of said corresponding first panel, said plurality of cuts on each of said first panels extending from said perimeter edge of said corresponding first panel toward a center of said corresponding first panel, said plurality of cuts on each of said first panels being spaced apart from each other and being distributed around said corresponding panel to define a plurality of tentacles on each of said first panels, each of said first panels being oriented to be offset with respect to each other such that four corners corresponding to each of said first panels is offset with respect to adjacent first panels, said stacked panels including a bottom first panel and a top first panel;

a second panel being positioned on said bottom first panel, said second panel having a primary surface and a secondary surface, said second panel having a plurality of perforations, each of said perforations extending through said primary and secondary surfaces, said perforations being oriented to form an X being centrally positioned on said second panel; and a coupler being configured to engage a finger, said coupler being coupled to each of said first panels and said second panel wherein said plurality of first panels and said second panel is configured to be manipulated to clean the surface, said coupler comprising:

a pin having a first end and a second end, said pin extending through each of said first panels and said perforations on said second panel, a ring being coupled to said first end having said ring lying on said first surface corresponding to said top first panel wherein said ring is configured to have the finger extended therethrough, and a disk having a first surface, said first surface of said disk being coupled to said second end of said pin having said first surface of said disk abutting said secondary surface of said second panel such that said disk inhibits said pin from being removed from said second panel.

9. A cleaning assembly being configured to be worn on a finger thereby facilitating said assembly to clean surfaces, said assembly comprising:

a plurality of first panels, said first panels being stacked on top of each other, each of said first panels being comprised of a deformable material wherein each of said first panels is configured to clean a surface;

a coupler being configured to engage a finger, said coupler being coupled to each of said first panels wherein said plurality of first panels is configured to be manipulated to clean the surface; and a second panel being positioned on a bottom one of said first panels, said second panel having a primary surface and a secondary surface, said second panel having a plurality of perforations, each of said perforations extending through said primary and secondary surfaces, said perforations being oriented to form an X being centrally positioned on said second panel.

* * * * *